US005990613A

United States Patent [19]

Ageno et al.

[11] Patent Number: 5,990,613

[45] Date of Patent: Nov. 23, 1999

[54] FIELD EMISSION DEVICE HAVING A NON-COATED SPACER

[75] Inventors: Scott K. Ageno, Phoenix; Peter A. Smith, Chandler, both of Ariz.; Rong-Fong Huang; Joyce K. Yamamoto, both of Albuquerque, NMex.; Craig Amrine, Tempe, Ariz.

[73] Assignee: Motorola, Inc., Schaummburg, Ill.

[21] Appl. No.: 09/009,097

[22] Filed: Jan. 20, 1998

[51] Int. Cl.[6] ..... H01J 19/42; H01J 29/18; H01J 1/62

[52] U.S. Cl. ..... 313/495; 313/292; 313/422

[58] Field of Search ..... 313/309, 336, 313/292, 495, 496, 422

[56] References Cited

U.S. PATENT DOCUMENTS

| | | | |
|---|---|---|---|
| 4,882,651 | 11/1989 | Maher | 361/321 |
| 5,083,058 | 6/1990 | Nonomura et al. | 313/422 |
| 5,509,840 | 4/1996 | Huang et al. | 445/24 |
| 5,532,548 | 7/1996 | Spindt et al. | 313/422 |
| 5,589,731 | 12/1996 | Fahlen et al. | 313/495 |
| 5,614,781 | 3/1997 | Spindt et al. | 313/422 |
| 5,667,418 | 9/1997 | Fahlen et al. | 445/24 |
| 5,675,212 | 10/1997 | Schmid et al. | 313/422 |
| 5,742,117 | 4/1998 | Spindt et al. | 313/422 |

*Primary Examiner*—Nimeshkumar D. Patel
*Assistant Examiner*—Joseph Williams
*Attorney, Agent, or Firm*—Kate Tobin; S. Kevin Pickens

[57] ABSTRACT

A field emission display (100) includes a cathode plate (102) having a plurality of electron emitters (124), an anode plate (104) opposing the cathode plate (102), and a bulk-resistive spacer (108) extending between the anode plate (104) and the cathode plate (102). The bulk-resistive spacer (108) is made from an electrically conductive material. The resistivity of the electrically conductive material is selected to remove impinging charges while preventing excessive power loss due to electrical current through the bulk-resistive spacer (108) from the anode plate (104) to the cathode plate (102).

20 Claims, 1 Drawing Sheet

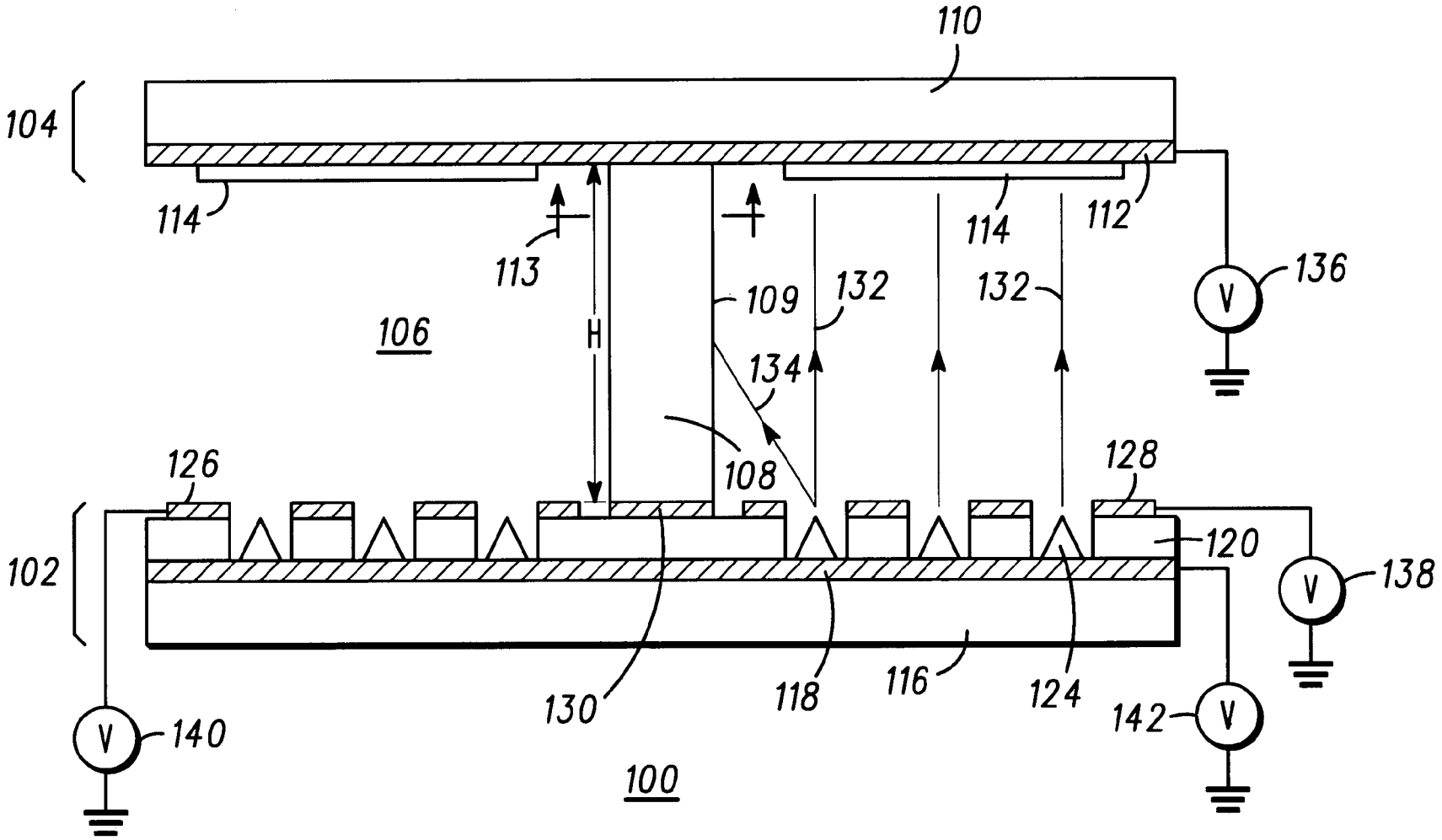
110
104
114
112
136
114
132
132
109
134
108
H
113
106
126
128
120
138
124
116
118
130
100
140
142
102

FIELD EMISSION DEVICE HAVING A NON-COATED SPACER

REFERENCE TO RELATED APPLICATION

Related subject matter is disclosed in a U.S. patent application entitled "Field Emission Device Having a Composite Spacer", filed on Dec. 17, 1997, and assigned to the same assignee.

FIELD OF THE INVENTION

The present invention pertains to the area of field emission devices and, more particularly, to field emission displays.

BACKGROUND OF THE INVENTION

It is known in the art to use spacer structures between the cathode and anode plates of a field emission display. The spacer structures maintain the separation between the cathode and the anode plates and prevent implosion of the plates due to the pressure difference between the internal vacuum and the external atmospheric pressure. The spacer structures must also withstand the potential difference between the cathode and the anode.

However, spacers can adversely affect the flow of electrons from the cathode plate toward the anode plate in the vicinity of the spacers. Spacers have been made from dielectric materials, which can withstand the potential difference between the cathode and anode plates and prevent power losses due to electrical conduction between the plates. However, the surfaces of a dielectric spacer can become electrostatically charged by some of the electrons emitted from the cathode plate in the vicinity of the spacers. The charging phenomenon changes the voltage distribution near the spacers from the desired voltage distribution. The change in voltage distribution near the spacers can result in distortion of the electron flow. It can also result in electrical arcing, as between the spacers and the cathode plate.

In a field emission display, this distortion of the electron flow proximate to the spacers can result in distortions in the image produced by the display. In particular, the distortions render the spacers "visible" by producing a dark region in the image at the location of each spacer.

Several prior art spacers attempt to solve the problems associated with spacer charging. For example, it is known in the art to provide a spacer that includes a bulk dielectric material and that has a conductive surface. The conductive surface has a sheet resistance that is low enough to remove accumulated charge by conduction, yet high enough to ameliorate power losses due to electrical current between the anode and cathode plates. The resistive surface can be realized by coating the spacer with a film having the desired resistance. A typical thickness of the resistive coating is less than 1 micrometer.

Many difficulties are encountered with prior art coated spacers. For example, uniformity and reproducibility of very thin resistive films is difficult to realize. Non-uniformity in the thickness of the film ultimately can cause nonuniformity in the output of the device, such as non-uniformity in a display image of a field emission display device. This can be due to, for example, areas or points on the spacers that are capable of becoming charged.

Other disadvantages of coated spacers are the limited electrical ruggedness, mechanical ruggedness, and chemical ruggedness of the resistive coatings. For example, the coatings may not be compatible with other materials within the device or with the vacuum environment. For operating performance to remain constant over the life of the device, the properties of the resistive coating must remain constant. The properties of the coating must not be altered by the impinging electron current, temperature treatments, chemical interactions, etc, during fabrication and during operation of the device.

However, very thin resistive coatings can be sensitive to, for example, the electrical load derived from the current between the anode and the cathode and from impinging charges during the operation of the field emission device. The maximum current density that can be withstood by a very thin resistive film may be too low to accommodate the potential difference between the anode and the cathode. If the current density within the coating exceeds the maximum value for the coating, overheating and material breakdown of the resistive film may occur.

It is also known in the art to provide electrodes on the spacers for the purpose of deflecting or focusing electrons, so that they do not impinge upon the spacer surfaces. This prior art scheme adds complexity and cost to the processes for manufacturing and operating the devices.

Accordingly, there exists a need for an improved field emission device, which has spacers that reduce distortion of electron flow and that do not result in excessive power losses.

BRIEF DESCRIPTION OF THE DRAWING

The sole FIGURE is a cross-sectional view of an embodiment of a field emission device in accordance with the invention.

It will be appreciated that for simplicity and clarity of illustration, elements shown in the FIGURE have not necessarily been drawn to scale. For example, the dimensions of some of the elements are exaggerated relative to each other.

DESCRIPTION

The invention is for a field emission device having bulk-resistive spacers extending between an anode plate and a cathode plate. The bulk-resistive spacer of the invention is electrically conductive over the entirety of its cross-sectional area along the entirety of its height. Thus, electrical current due to charged species impinging upon the bulk-resistive spacer can be distributed over the cross-sectional area of the bulk-resistive spacer. This feature provides the advantage of distributing the current over the cross-sectional area of the bulk-resistive spacer. In this manner, the current density is reduced over that of prior art spacers having a resistive coating disposed on a dielectric bulk. The reduced current density results in numerous advantages, such as reduced heating and reduced risk of material breakdown. The bulk-resistive spacer of the invention is made from a material characterized by electrical conductivity that is controlled by electron and hole concentration. The material is characterized by electrical conductivity dominated by the movement of electrons/holes.

The resistivity of this material is selected to remove the electrical charges impinging on the bulk-resistive spacer during the operation of the device, while not causing excessive power losses due to current generated between the anode plate and cathode plate of the device. The bulk-resistive spacers of the invention are also simpler to fabricate than prior art coated spacers.

The sole FIGURE is a cross-sectional view of a field emission display (FED) 100 in accordance with the invention. FED 100 has a cathode plate 102, which opposes an anode plate 104. An evacuated region 106 exists between cathode plate 102 and anode plate 104. The pressure within evacuated region 106 is less than about $1.33\times10^{-4}$ Pascals ($10^{-6}$ torr).

FED 100 further includes a bulk-resistive spacer 108, which extends between cathode plate 102 and anode plate 104. Bulk-resistive spacer 108 provides mechanical support to maintain the separation between cathode plate 102 and anode plate 104. While the FIGURE illustrates only one spacer, it is desired to be understood that a field emission device in accordance with the invention can have a plurality of spacers. The quantity and configuration of the spacers depend on factors such as the thickness of the substrates of the cathode and anode plates and the overall size of the device. Bulk-resistive spacer 108 also has features that ameliorate electrostatic charging of a surface 109 of bulk-resistive spacer 108. By controlling the electrostatic charging of bulk-resistive spacer 108, distortions of the trajectory of an electron current 132 within FED 100 are also controlled. In the embodiment of the FIGURE, bulk-resistive spacer 108 has features that render it invisible to a viewer of FED 100 during its operation.

Bulk-resistive spacer 108 is also characterized by an acceptable level of power dissipation due to electrical current from anode plate 104 to cathode plate 102 through bulk-resistive spacer 108. Preferably, the power dissipation due to current from the anode plate to cathode plate through the entirety of the spacers during the operation of the device is less than 10 percent of the total power consumption of the device. For example, if the device uses 1 watt of power, the power loss through the spacers is less than 100 milliwatts.

Cathode plate 102 includes a substrate 116, which can be made from glass, silicon, and the like. Upon substrate 116 is disposed a cathode conductor 118, which can include a thin layer of molybdenum. A dielectric layer 120 is formed on cathode conductor 118. Dielectric layer 120 can be made from, for example, silicon dioxide. Dielectric layer 120 defines a plurality of emitter wells, in which are disposed one each a plurality of electron emitters 124. In the embodiment of the FIGURE, electron emitters 124 include Spindt tips.

However, a field emission device in accordance with the invention is not limited to Spindt tip electron sources. For example, an emissive carbon film can alternatively be employed for the electron source of the cathode plate.

Cathode plate 102 further includes a plurality of gate electrodes. A first gate electrode 126 and a second gate electrode 128 are illustrated in the FIGURE. In general, the gate electrodes are used to selectively address electron emitters 124.

Anode plate 104 includes a transparent substrate 110, upon which is disposed an anode conductor 112, which is transparent and can include a thin layer of indium tin oxide. A plurality of phosphors 114 is disposed upon anode conductor 112. Phosphors 114 oppose electron emitters 124.

A first voltage source 136 is connected to anode conductor 112. A second voltage source 138 is connected to second gate electrode 128. A third voltage source 140 is connected to first gate electrode 126, and a fourth voltage source 142 is connected to cathode conductor 118.

Bulk-resistive spacer 108 extends between cathode plate 102 and anode plate 104 to provide mechanical support. The height of bulk-resistive spacer 108 is sufficient to aid in the prevention of electrical arcing between anode plate 104 and cathode plate 102. For example, for a potential difference between anode plate 104 and cathode plate 102 of greater than about 2500 volts, the height of bulk-resistive spacer 108 is greater than about 500 micrometers, preferably within a range of 700–1200 micrometers. One end of bulk-resistive spacer 108 contacts anode plate 104, at a surface that is not covered by phosphors 114; the opposing end of bulk-resistive spacer 108 contacts cathode plate 102, at a portion that does not define the emitter wells.

As illustrated in the FIGURE, bulk-resistive spacer 108 has a height, H, and a cross-section, which is taken along a section line 113, as indicated in the FIGURE. In accordance with the invention, bulk-resistive spacer 108 is conductive across the entirety of this cross-sectional area. Thus, bulk-resistive spacer 108 is conductive at surface 109, which is located in evacuated region 106, and at its interior, within the bulk. Bulk-resistive spacer 108 is also conductive over the entirety of its height, H. In the preferred embodiment, bulk-resistive spacer 108 has a uniform resistivity over the cross-sectional area and over the entirety of its height, H.

Bulk-resistive spacer 108 is made from a material selected to achieve the objectives described above. The bulk resistive material is composed of at least one component with the appropriate resistivity, and there can be other components that possess a resistivity higher than the first component. The conduction mechanism within bulk-resistive spacer 108 is determined by the material defect structure, which fixes the electron/hole concentration. The conduction mechanism is characterized by electronic conduction, rather than ionic conduction. The conduction within bulk-resistive spacer 108 is dominated by the movement of electrons and holes, rather than atomic mobility. Ionic conductivity, in which atoms are the mobile species, is not a suitable conduction mechanism for bulk-resistive spacer 108 because it would cause compositional changes across the spacer over the lifetime of the device. Thus, for long-term compositional stability, an electronic conduction mechanism is provided.

The material comprising bulk-resistive spacer 108 is also selected to satisfy the following criteria. First, it must be able to withstand the applied potential. Second, it must be able to conduct to an extent sufficient to remove impinging charges during the operation of the device. Third, it must not dissipate power at a rate greater than ten percent of the total power used by the device. If more than one spacer is used, the power loss through the totality of the spacers must not be greater than ten percent of the total power. Fourth, the material of bulk-resistive spacer 108 preferably has a high work function in order to ameliorate spurious electron emission from surface 109. Finally, the material must also be inert with respect to other materials present within the device, such as the materials of cathode plate 102 and anode plate 104. For example, the characteristic of inertness is desirable for preventing the formation of intermetallics and other undesirable chemical reactions, which can adversely affect electron emission.

In the preferred embodiment of the invention, bulk-resistive spacer 108 is connected to a potential, which is useful for removing the electrical charges impinging on bulk-resistive spacer 108 during the operation of FED 100. In the embodiment of the FIGURE, cathode plate 102 includes a conductive layer 130, which is connected to bulk-resistive spacer 108. Conductive layer 130 is disposed on dielectric layer 120 and includes a thin layer of a conductive material, such as molybdenum, aluminum, and the like. The discharging potential is provided at conductive layer 130 by, for example, connection to a fifth voltage source (not shown). It can also be provided by connection to a gate electrode. The former configuration allows the potential at conductive layer 130 to be independently controlled to provide the desired discharging characteristics of bulk-resistive spacer 108. The latter configuration does not require an additional potential source. Most preferably, conductive layer 130 is connected to electrical ground. The connection to electrical ground does not require additional power and, therefore, reduces the costs of fabricating and operating the device.

An exemplary configuration of a field emission device in accordance with the invention will now be described with reference to the FIGURE. It is desired to be understood that a field emission device embodying the invention is not limited to the precise geometric configuration described with reference to the FIGURE. This configuration is particularly useful for operation of FED 100 at potential differences between cathode plate 102 and anode plate 104, which are greater than about 300 volts, and preferably within a range of about 2500–10,000 volts. It also includes a VGA configuration. It is desired to be understood, however, that a field emission display embodying the invention is not limited to a VGA configuration.

Transparent substrate 110 and substrate 116 each have a thickness of about one millimeter. Bulk-resistive spacer 108 includes a rectangular platelet, which has a length (into the page) of about 5 millimeters, a height, H, (extending between cathode plate 102 and anode plate 104) of about 1 millimeter, and a thickness of about 0.07 millimeters. The center-to-center distance between first and second gate electrodes 126, 128 is about 0.3 millimeters. FED 100 can be operated at a potential difference between anode conductor 112 and first and second gate electrodes 126, 128 within a range of about 2500–10,000 volts. For this voltage range, the distance between anode plate 104 and cathode plate 102 is generally greater than 500 micrometers in order to reduce the risk of electrical arcing between anode plate 104 and cathode plate 102.

For the exemplary configuration described with reference to the FIGURE and for a potential difference between anode plate 104 and cathode plate 102 of about 5000 volts, the resistivity of the material from which bulk-resistive spacer 108 is made is preferably within a range of $10^8$–$10^{10}$ ohm-centimeters. For FED 100 having a potential difference of about 5000 volts, the preferred material for bulk-resistive spacer 108 is neodymium barium titanate. Another useful material for bulk-resistive spacer 108 is nickel oxide doped with silica to less than 4 mole %.

In general, bulk-resistive spacer 108 is made from a bulk-resistive material that is composed of one phase or a number of phases. The phases are assembled to provide the desired overall resistivity. A useful phase configuration can be selected from a wide variety of assemblies to provide the desired properties. Using percolation principles, many useful phase interconnective configurations can be realized and will be described presently.

In general, a bulk-resistive phase is composed of two phases or groups of phases. One phase or group of phases, $P_1$, is insulating, and the other phase or group of phases, $P_2$, is less insulating than $P_1$, or the conductivity of $P_1$ is less than the conductivity of $P_2$. There are three general microstructures that represent the extremes of the percolation spectrum. These microstructures can form the framework for the conduction path within bulk-resistive spacer 108. They are based upon varying states of percolation of phases (s) $P_1$ in phase(s) $P_2$.

The first microstructure is characterized by an intergranular conduction path. This corresponds to the situation in which phase(s) $P_1$ (insulating phase) particles or grains are surrounded by $P_2$ (less insulating phase). Therefore, the conduction path occurs within $P_2$ and is in-between the $P_1$ particles or grains. This represents low percolation of $P_1$ in $P_2$.

The second and third microstructures are characterized by an intragranular conduction path. The second microstructure corresponds to the situation in which the particles or grains of the $P_1$ phase(s) are in direct contact with each other, and there may be minor amounts of $P_2$ present in the material. The conduction path is defined by the interconnected network structure of the $P_1$ phase particles of multiple particle-particle contact points.

In the third microstructure, there is a thin amount of $P_2$ phase in between the $P_1$ grains or particles, but the concentration of $P_2$ is negligible enough to permit electron tunneling. This maintains intragranular conduction despite the presence of a grain boundary phase. This represents high percolation of $P_1$ in $P_2$.

Any of the phases contained in the material of bulk-resistive spacer 108 could be crystalline or amorphous or a mixture of crystalline and amorphous structures. Examples of material systems that can support intergranular conduction include systems in which the interconnected conduction-determining phase is either a high or low volume fraction of the overall material. Low volume fraction refers to a grain boundary phase, and high volume fraction refers to a matrix incorporating the highly insulating phase. Specific examples include, but are not limited to: ceramic-metal composites, devitrified semiconducting glasses, ceramic-loaded semiconducting glasses, oxide and non-oxide ceramic systems, transition metal glass-ceramics, silicon nitride, silicon carbide, and neodymium barium titanate.

Examples of materials systems that support intragranular conduction include oxide and non-oxide ceramics, single crystals, zirconium oxide, and transition metal oxides, such as tin oxide, nickel oxide, manganese oxide, and titanium oxides.

Common to all of these material systems is the mechanism for electrical conduction where controlling the resistivity is accomplished by tailoring the electron/hole concentrations, either by using the intrinsic properties of the material or by using dopants to change the electron/hole concetration. The specie mobility is intrinsically determined by the material composition and structure.

During the operation of FED 100, potentials are applied to first and second gate electrodes 126, 128, cathode conductor 118, and anode conductor 112 to cause selected electron emission at electron emitters 124 and to direct the electrons through evacuated region 106 toward phosphors 114. Phosphors 114 are caused to emit light by the impinging electrons. As illustrated in the FIGURE, a plurality of impinging electrons 134 impinge upon bulk-resistive spacer 108. Bulk-resistive spacer 108 is sufficiently conductive to prevent impinging electrons 134 from causing surface 109 to become electrostatically charged.

The magnitude of the electron current impinging upon bulk-resistive spacer 108 depends upon the particular configuration of FED 100 and the operating parameters. For example, the magnitude of the impinging electron current depends upon the magnitude of electron current 132, the distance between bulk-resistive spacer 108 and electron emitters 124, the values of the applied voltages, and the geometry of electron emitters 124.

A bulk-resistive spacer in accordance with the invention can be made using economical and convenient methods.

Fabrication of the bulk-resistive spacer of the invention does not require photolithographic steps, expensive x-ray lithography, or highly directional etching and deposition techniques. It also does not require steps that coat the electron emitters, which can risk the integrity of the electron emitters.

Bulk-resistive spacer 108 can be made by first forming a sheet of bulk resistive material. One of two basic types of forming methods can be employed. The first type of method for ceramic powder consolidation is dry pressing; the other is tape casting. The dry pressing method is characterized by pouring dry ceramic powders into a die and, through the application of the appropriate pressure, the ceramic powders are consolidated into a dense body. The ceramic powders can be uniaxially pressed, where the pressure is applied in one direction, or isostatically pressed, where the pressure is uniformly applied in all directions. Isostatic pressing can be achieved by controlling the applied pressure via either oil or water mediums. Prior to pressing, the surface of the ceramic powders needs to be modified through the introduction of organic compounds (dispersants, binders, etc.) that serve to control particle-particle bonding through electrostatic inter-particle interactions, so as to increase the density of the as-pressed body. Once the piece has been formed, the body is fired at a temperature close to but not greater than the material's melting temperature. This results in a dense, low porosity body.

The second basic type of forming method is tape casting. The tape or flexible layer is made by casting a mixture of solid particles (glass, ceramic, metal, polymeric), binders, dispersants, and plasticizers into thin sheets. These sheets can be cut or patterned before they are stacked to the desired thickness. The stack is pressed together either with or without increasing the temperature of the layers and is then filed to form a dense, solid monolithic body. The layers of the stack need not have the same resistivity.

The monolith thus formed is then sliced, diced, or cut into individual spacers. For example the monolith can be cut using a wire saw or dicing saw.

Methods for forming anode plate 104 and cathode plate 102 are known to one skilled in the art. After anode plate 104 and cathode plate 102 are made, bulk-resistive spacers 108 can be bonded to conductive layer 130 by, for example, thermal compression bonding to maintain a perpendicular configuration with respect to cathode plate 102. Anode plate 104 is then placed upon bulk-resistive spacers 108 and the package is hermetically sealed in a vacuum environment.

In summary, the invention is for a field emission device having bulk-resistive spacers. The bulk-resistive spacers of the invention are sufficiently conductive to prevent electrostatic charging of the surfaces of the bulk-resistive spacers while controlling power loss between the anode plate and the cathode plate of the device. They are also mechanically and electrically more rugged than coated spacers of the prior art. In the preferred embodiment, the bulk-resistive spacer of the invention has a uniform resistivity over its cross-section along the entirety of its height.

We claim:

1. A field emission device comprising:

a cathode plate having a plurality of electron emitters;

an anode plate disposed to receive an electron current emitted by the plurality of electron emitters; and a bulk-resistive spacer extending between the anode plate and the cathode plate and having a height and a cross-sectional area, the bulk-resistive spacer being electrically conductive over the cross-sectional area along the height, wherein the bulk-resistive spacer has a uniform resistivity over the cross-sectional area along the height, and wherein the bulk-resistive spacer comprises an electrically conductive material having a resistivity within the range of $10^8$–$10^{10}$ ohm-cm.

2. The field emission device as claimed in claim 1, further including an evacuated region disposed between the cathode plate and the anode plate, wherein the bulk-resistive spacer has a surface disposed within the evacuated region and further has a bulk region having a resistivity, wherein the surface has a resistivity equal to the resistivity of the bulk region.

3. The field emission device as claimed in claim 1, wherein the field emission device is characterized by a total power consumption, wherein the bulk-resistive spacer is characterized by a power dissipation, and wherein the power dissipation of the bulk-resistive spacer is less than ten percent of the total power consumption of the field emission device.

4. The field emission device as claimed in claim 1, wherein the bulk-resistive spacer comprises a material characterized by electrical conductivity dominated by movement of electrons and holes.

5. The field emission device as claimed in claim 4, wherein the material comprising the bulk-resistive spacer is selected from the group consisting of ceramic-metal composites, devitrified semiconducting glasses, ceramic-loaded semiconducting glasses, oxide ceramics, non-oxide ceramics, transition metal glass-ceramics, silicon nitride, silicon carbide, neodymium barium titanate, zirconium oxide, single crystals, transition metal oxides, and combinations thereof.

6. The field emission device as claimed in claim 1, wherein the cathode plate comprises a conductive layer, and wherein the conductive layer is connected to the bulk-resistive spacer whereby electrostatic charge developed on the bulk-resistive spacer during operation of the field emission device is removed through the conductive layer.

7. The field emission device as claimed in claim 6, wherein the cathode plate comprises a plurality of gate electrodes, and wherein the conductive layer is connected to one of the plurality of gate electrodes.

8. The field emission device as claimed in claim 1, wherein the bulk-resistive spacer comprises neodymium barium titanate.

9. A field emission device comprising:

a cathode plate having a plurality of electron emitters;

an anode plate disposed to receive an electron current emitted by the plurality of electron emitters; and a bulk-resistive spacer extending between the anode plate and the cathode plate and having a height and a cross-sectional area, the bulk-resistive spacer consisting essentially of an electrically conductive material having a resistivity within a range of $10^8$–$10^{10}$ ohm-cm, and wherein the bulk-resistive spacer has a uniform resistivity over the cross-sectional area along the height.

10. The field emission device as claimed in claim 9, wherein the electrically conductive material is characterized by electrical conductivity dominated by movement of electrons and holes.

11. A field emission display comprising:

a cathode plate having a plurality of electron emitters;

an anode plate having a phosphor, wherein the phosphor is disposed to receive an electron current emitted by the plurality of electron emitters; and a bulk-resistive spacer extending between the anode plate and the cathode plate and having a height and a cross-sectional area, the bulk-resistive spacer being electrically conductive over the cross-sectional area along the height, wherein the bulk-resistive spacer has a uniform resistivity over the cross-sectional area along the height, and wherein the bulk-resistive spacer comprises an electrically conductive material having a resistivity within the range of $10^8$–$10^{10}$ ohm-cm.

12. The field emission display as claimed in claim 11, further including an evacuated region disposed between the cathode plate and the anode plate, wherein the bulk-resistive spacer has a surface disposed within the evacuated region and further has a bulk region having a resistivity, wherein the surface has a resistivity equal to the resistivity of the bulk region.

13. The field emission display as claimed in claim 11, wherein the field emission display is characterized by a total power consumption, wherein the bulk-resistive spacer is characterized by a power dissipation, and wherein the power dissipation of the bulk-resistive spacer is less than ten percent of the total power consumption of the field emission display.

14. The field emission display as claimed in claim 11, wherein the bulk-resistive spacer comprises an electrically conductive material characterized by electrical conductivity dominated by movement of electrons and holes.

15. The field emission display as claimed in claim 14, wherein the material comprising the bulk-resistive spacer is selected from the group consisting of ceramic-metal composites, devitrified semiconducting glasses, ceramic-loaded semiconducting glasses, oxide ceramics, non-oxide ceramics, transition metal glass-ceramics, silicon nitride, silicon carbide, neodymium barium titanate, zirconium oxide, single crystals, transition metal oxides, and combinations thereof.

16. The field emission display as claimed in claim 11, wherein the cathode plate comprises a conductive layer, and wherein the conductive layer is connected to the bulk-resistive spacer whereby electrostatic charge developed on the bulk-resistive spacer during operation of the field emission display is removed through the conductive layer.

17. The field emission display as claimed in claim 16, wherein the cathode plate comprises a plurality of gate electrodes, and wherein the conductive layer is connected to one of the plurality of gate electrodes.

18. The field emission display as claimed in claim 11, wherein the bulk-resistive spacer comprises neodymium barium titanate.

19. A field emission display comprising:

a cathode plate having a plurality of electron emitters;

an anode plate having a phosphor, wherein the phosphor is disposed to receive an electron current emitted by the plurality of electron emitters; and a bulk-resistive spacer extending between the anode plate and the cathode plate and having a height and a cross-sectional area, the bulk-resistive spacer consisting essentially of an electrically conductive material having a resistivity within a range of $10^8$–$10^{10}$ ohm-cm, and wherein the bulk-resistive spacer has a uniform resistivity over the cross-sectional area along the height.

20. The field emission display as claimed in claim 19, wherein the electrically conductive material is characterized by electrical conductivity dominated by movement of electrons and holes.

* * * * *